United States Patent [19]

Boyd et al.

[11] Patent Number: 4,573,042

[45] Date of Patent: Feb. 25, 1986

[54] ELECTRONIC ARTICLE SURVEILLANCE SECURITY SYSTEM

[75] Inventors: Robert C. Boyd, Scottsdale; Charles L. La Patra, Chandler, both of Ariz.

[73] Assignee: Sensormatic Electronics Corporation, Boca Raton, Fla.

[21] Appl. No.: 474,966

[22] Filed: Mar. 14, 1983

[51] Int. Cl.[4] ..... G08B 1/08; G08B 13/14

[52] U.S. Cl. ..... 340/539; 340/568; 340/571; 340/572

[58] Field of Search ..... 340/539, 571, 568, 572, 340/573, 586, 596, 521, 522, 531, 546

[56] References Cited

U.S. PATENT DOCUMENTS

| | | | |
|---|---|---|---|
| Re. 27,618 | 4/1973 | Robeson | 340/571 |
| 3,551,906 | 12/1970 | Cooper | 340/571 |
| 3,713,133 | 1/1973 | Nathans | 340/539 |
| 3,781,860 | 12/1973 | Frexling, Jr. | 340/571 |
| 3,806,910 | 4/1974 | Keifer et al. | 340/572 |
| 4,090,183 | 5/1978 | Miller | 340/571 |
| 4,352,097 | 9/1982 | Hamann | 340/571 |

OTHER PUBLICATIONS

Hobby Electronics, "Bike Alarm", Apr. 1982.

*Primary Examiner*—Donnie L. Crosland
*Attorney, Agent, or Firm*—Robin, Blecker & Daley

[57] ABSTRACT

Apparatus for releasable attachment to articles to be monitored by a surveillance system of type involving radiant energy transmissions into an area of interest. The apparatus includes: an attachment device for effecting releasable attachment of the apparatus to an article and having an electrical switch with first and second states corresponding respectively to attachment thereof to the article and to release thereof from attachment; an alarm unit operable for generating an output indicative of an alarm condition; a receiver for receipt of radiant energy transmitted messages; and control circuitry connected to both the attachment device and the receiver for response to the attachment device switch second state and to messages received by the receiver for operating the alarm means to generate output indicative of an alarm condition. The apparatus may further include a negator unit for removing the alarm unit from generation of the alarm condition.

23 Claims, 13 Drawing Figures

FIG. 4
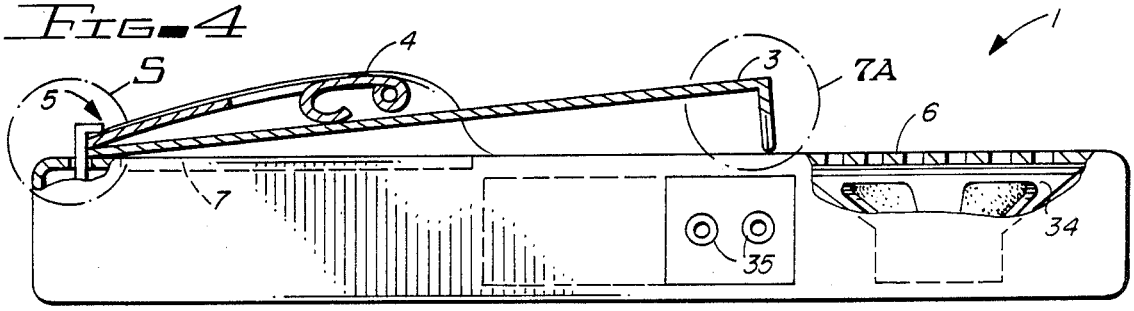
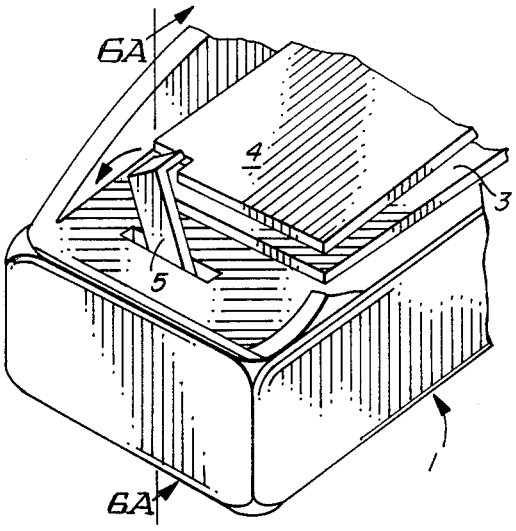
FIG. 5
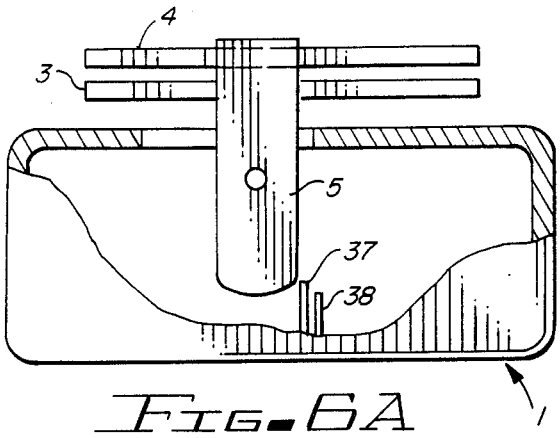
FIG. 6A
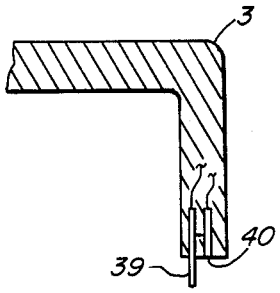
FIG. 7A
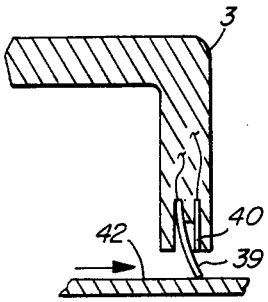
FIG. 7B
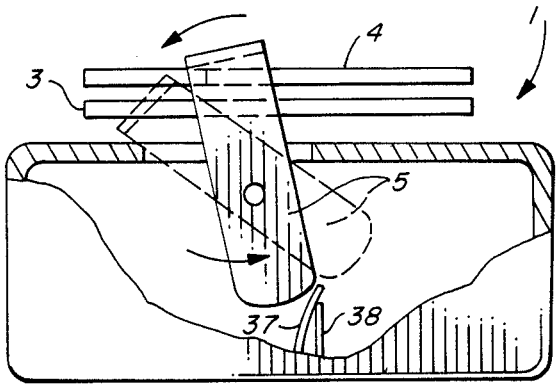
FIG. 6B
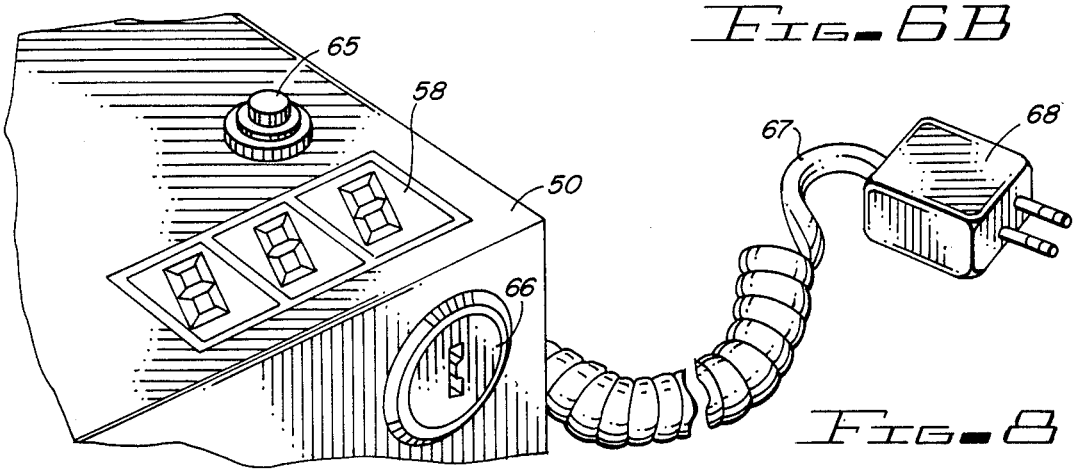
FIG. 8

ELECTRONIC ARTICLE SURVEILLANCE SECURITY SYSTEM

FIELD OF THE INVENTION

Our invention is a security system designed to protect merchandise against losses, as those losses relate to shoplifting and employee theft.

SUMMARY OF THE INVENTION

Our invention is comprised of three (3) interrelated components that, when used in conjunction with one another, embody a system of security. A transmitter is used to generate and transmit a radio frequency signal, through a directional antenna, to a specific location. A alarm device, containing it's own power source, is attached to an article of merchandise that is to be protected. The alarm device will, when brought into the radio frequency transmission area, detect the radio frequency signal, rejecting all but the radio frequency signal being broadcast by the transmitter provided, in turn developing a tone to a speaker which then broadcasts an audible tone. This audible tone will be broadcast each time the alarm device is separated from the merchandise, to which it is attached, regardless of the circumstances of that separation and the audible tone will be broadcast each time the alarm device is brought into the transmission area. The alarm device will continue to broadcast the audible tone until it is reset, placed in a quiescent state, using an external power source. The third component, in our security system, is the negator. The negator is the external power source used to reset, place in a quiescent state, the alarm device, causing the audible tone broacast to stop. Each time the negator is used to reset an alarm device it's use in recorded and registered in a light emiting diode (LED) display located in the case of the negator.

It is an oject of the invention to provide an improved security system that effectively establishes strict physical parameters of free movement, by persons in possession of merchandise to which a alarm device is attached, by placement of the transmitters provided. It is another object of the invention to expand the effective area of apprehension beyond the immediate location of the violation by converting the detection area to a period of time rather than distance, using the self-contained power source of the alarm device as the converting factor.

It is another object of the invention to provide a means whereby the inventions user can monitor and audit the activity of it's employees, as that activity relates to the exact number of alarm devices that are placed in a quiescent state during a given period of time.

These and other objects and features of the invention will be better understood from the following detailed description, reference being taken to the accompanying drawings in which:

DESCRIPTION OF THE DRAWINGS

FIG. 5 shows a detailed three quarter perspective view of the upper rear portion of the alarm device.

FIG. 6A shows a detailed side view of upper portion of the alarm device and the internal position of the attaching mechanism lock as that position relates to the lock contacts, while the attaching mechanism lock is in a locked position.

FIG. 6B shows a detailed side view of upper portion of the alarm device and the internal position of the attaching mechanism lock as that position relates to the lock contacts, while the attaching mechanism lock is is being moved into an open, or unlocked, position and the action caused by the lower portion of the lock armature as it comes into contact with the lock contacts.

FIG. 7A shows a detailed view of the internal position and location of the attaching mechanism jaw contacts.

FIG. 7B shows a detailed view of the reaction, by the attaching mechanism jaw contacts, to an attempt to remove merchandise from the alarm device's attaching mechanism while the attaching mechanism lock is in a locked position.

FIG. 8 shows the negator and it's external components.

FIG. 9 shows a schematic diagram of the alarm device.

DETAILED DESCRIPTION OF THE PREFERRED EMBODIMENT

Figures 1, 2, 3, 4:
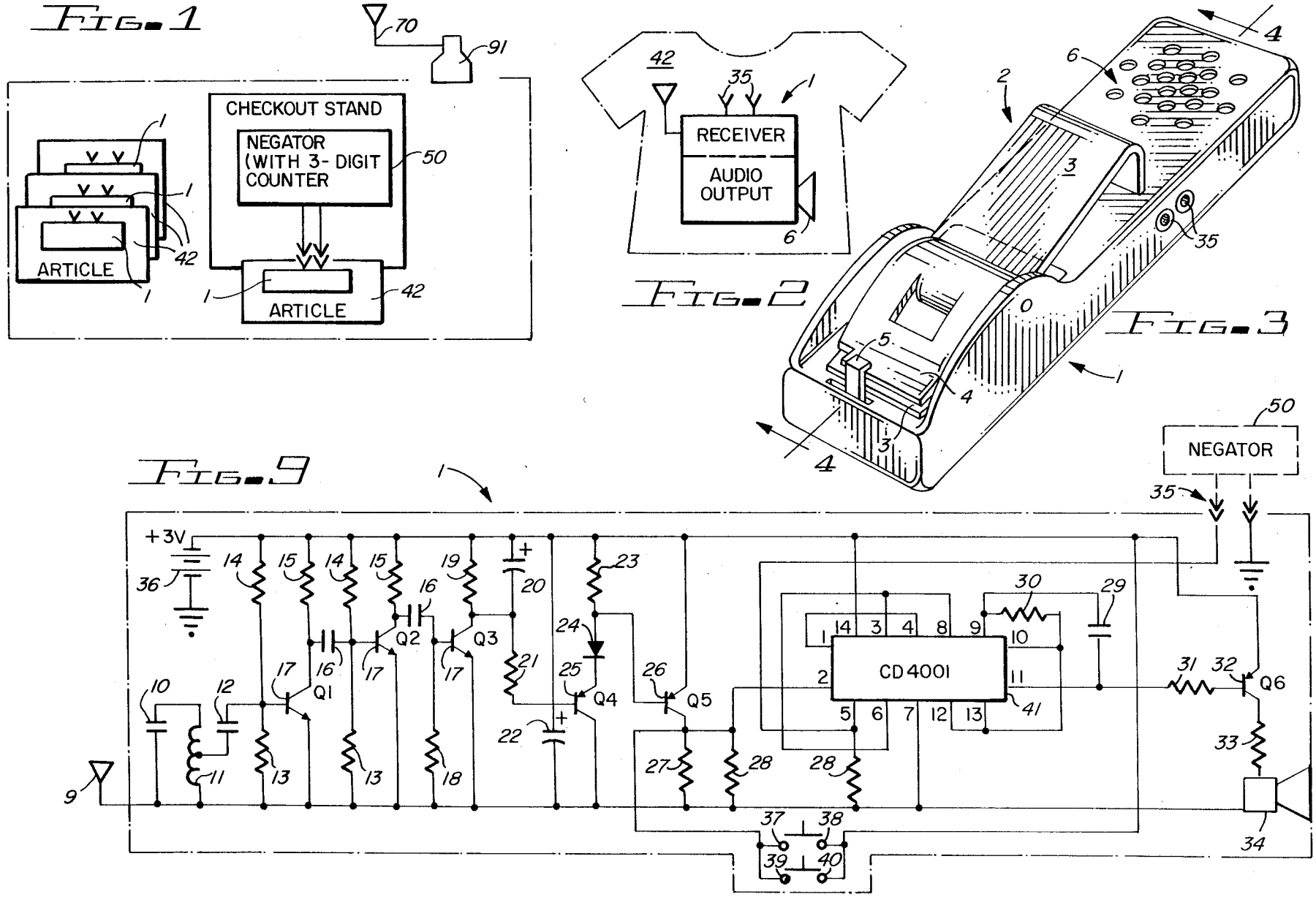
FIG. 1 shows the integral components of the invention; transmitter and directional antenna, alarm device and negator.
FIG. 2 shows the ordinary use of the alarm device, with radio frequency receiver and audio output capability, as the alarm device applies to a typical article of merchandise.
FIG. 3 shows a three quarter perspective view of the alarm device with it's external parts.
FIG. 4 shows a side view of the alarm device and several of it's internal and external component parts.

In FIG. 1 we have identified the three component parts of the invention; transmitter 70 and remote directional antenna 91, alarm device 1 and negator 50. Each is a separate, distinct and independently operating entity that, when used in consort with one another, embody a security system. In FIG. 3 we have shown the alarm device 1 with an attaching mechanism 2 that, when the attaching mechanism jaw 3 is drawn away from the alarm device 1, allows a typical article of merchandise 42 to be placed securely between the alarm device 1 and the attaching mechanism 2, more specifically the attaching mechanism jaw 3, which is then closed against the typical article of merchandise 42 and the alarm device 1, temporarily affixing the alarm device 1 to the typical article of merchandise 42, as shown in FIG. 2. Once the typical article of merchandise 42 is securely in place, having been placed between the alarm device 1 and the attaching merchandise jaw 3, the attaching mechanism spring clamp lock 5 is placed in a locked position, as shown in FIG. 6A. The attaching mechanism spring clamp lock 5, when in a locked position, applies a sufficient amount of pressure to the attaching mechanism spring clamp 4 which, in turn, exerts a sufficient amount of pressure against the attaching mechanism 2 and the attaching mechanism jaw 3 to prevent a typical article of merchandise 42 from being inadvertently separated from the alarm device 1.

In FIG. 7A we have shown the attaching mechanism jaw 3 and the attaching mechanism jaw contacts 39 and 40. Attaching mechanism jaw contact 39 extends past the surface of the attaching mechanism jaw 3 and the attaching mechanism jaw contact 40 is wholly contained within the attaching mechanism jaw 3 itself. In FIG. 7B we have shown the reaction of attaching mechanism jaw contacts 39 and 40 when a typical article of merchandise 42 is forced, with a pulling action, from between the alarm device 1 and the attaching mechanism jaw 3, while the attaching mechanism spring clamp lock 5 is in a locked position, as shown in FIG. 6A. Attaching mechanism jaw contact 39 will, because it extends past the surface of the attaching mehanism jaw 3 and rests upon the surface of the typical article of merchandise 42, be drawn, along with the typical article of merchandise, into attaching mechanism jaw contact 40 making contact with same.

Contact being made between attaching mechanism jaw contacts 39 and 40 will, as shown in FIG. 9, activate Q5 26 sending a voltage of sufficient amplitude, as provided by batteries 36, to activate CD 4001 Integrated circuit Quad 2 Input Nor Gate 41, which is a self latching audio tone generator when components 100K ohm resistors 28, 100 PF capacitor 29 and 820K resistor 30 are introduced to the circuit, audio is then amplified by Q6 and sent to the speaker 34, producing an audible tone.

In FIG. 6A we have shown the proximity of the spring clamp lock 5 to the spring clamp lock contacts 37 and 38. Spring clamp lock contact 37 is longer than spring clamp lock contact 38 to allow contact between spring clamp lock contacts 37 and 38 only when the spring clamp lock 5 is being unlocked, as shown in FIG. 6B. The reverse action, or locking notion, of the spring clamp lock 5 will allow the spring clamp lock 5 armature to pass over, without coming in contact, spring clamp lock contact 38. The same locking motion will cause spring clamp lock 5 armature to come into contact with spring clamp lock contact 37, forcing spring clamp lock 37 to move in a direction away from spring clamp lock contact 38, averting a connection being made between spring clamp lock contacts 37 and 38.

In FIG. 6B we have shown contact being made between spring clamp lock contacts 37 and 38 when the spring clamp lock 5 is being moved from a locked into an unlockedposition. This unlocking motion of spring clamp lock 5, causing spring clamp lock contacts 37 and 38 to meet and make a connection and, in turn, as shown in FIG. 9, activating Q5 26 sending a voltage of sufficient amplitude, as provided by batteries 36, to CD4001 Integrated circuit Quad 2 Input Nor Gate which is a self latching audio tone generator, when components 100K ohm resistor 28, 100 PF capacitor 29 and 820K resistor 30 are introduced to the circuit, audio is then amplified by Q6 and fed to speaker 34, producing an audible tone.

Figure 10:
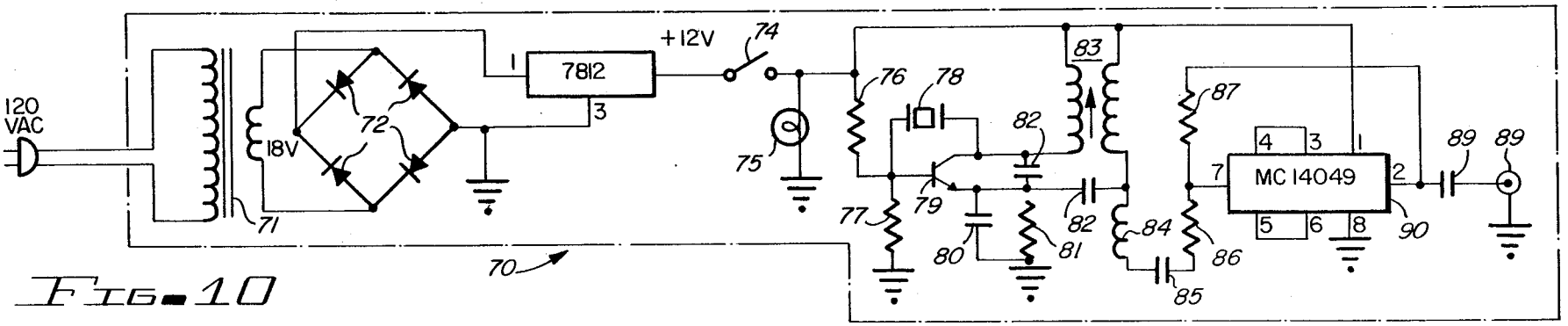
FIG. 10 shows a schematic diagram of the transmitter.

In FIG. 10 we have shown a schematic diagram of the transmitter 70. The transmitter 70 is powered by 120 volts alternating electric current provided through an electric cord which is connected, either through a plug or directly wired into an external electric power source, to the transmitter 70. The 120 volts of alternating current is then rectified and regulated through a 120 volt primary to 18 volt secondary power transformer 71, IN 4002 diodes 72 and 12 volt regulator 73. A key switch 74 when activated, or turned to the on position, allows the 12 volts to feed the radio frequency transmitter 70. When the key switch 74 is activated it provides 12 volts to a 12 volt lamp 75 that acts a visual operating indicator. The 12 volts passes through 33K ohm resistor 76, 5.6K ohm resistor 77, crystal 78, 2 SC 1815 transistor 79, 500 PF capacitor 80, 330 ohm resistor 81, 50 PF capacitor 82, slug tuned transformer 83 and radio frequency choke 84 all of which comprise a radio frequency oscillator. A 0.01 UF capactior 85 couples the radio frequency into MC 14049 90 , a hex/inverter buffer, which, along with 1 meg, ohm resistor 86 and 10 meg. ohm resistor 87, is a linear amplifier. The radio frequency signal is then fed through 4700 PF capacitor 88 to the remote directional antenna 91, as shown in FIG. 1. The transmitter 70 is connected to the remote directional antenna 91 using an amphenol connector 89 with an appropriate extension cord, sending a continuous radio frequency signal through the directional antenna 91 to a specific area. When an alarm device 1 is carried into the broadcast area of the radio frequency transmitter 70, as determined by the location of the remote directional antenna 91, the alarm device antenna 9, as shown in FIG. 9, will receive the radio frequency signal. A 2.7 PF capacitor 10 and a centertapped radio frequency coil 11 form a tuned circuit to reject all but the transmitted frequency. A 10 PF capacitor 12 couples the radio frequency signal to the base of 2N 3904 transistor Q1 17 and 560K resistor 13, 1 meg. resistor 14 and 47K resistor 15 bias Q1 17. 0.1 UF capactior 16 couples the radio frequency signal to the base of Q2 17 and 1 meg. resistor 14, 47K resistor 15 and 0.1 UF capacitor 16 bias Q2 17 while 330K resistor 18, 6.8K resistor 19 and 10 UF electrolytic capacitor 20 bias Q3 17. 47 ohm resistor 21 couples the radio frequency signal to the base of Q4 25 and 2.2K resistor 23, IN 914 diode 24 and AC 126 transistor 25 form a detector that feeds Q5 26. 1K ohm resistor 27 is a load resistor for Q5 26, activating Q5 26 sending a voltage, as provided by batteries 36, of sufficient amplitude to activate CD 4001 Integrated circuit Quad 2 Input Nor Gate 41 which is a self latching audio tone generator, when components 100K ohm resistor 28, 100 PF capacitor 29 and 820K resistor 30 are introduced to the circuit, audio is then amplified by Q6 and fed to speaker 34, producing an audible tone.

Figure 11:
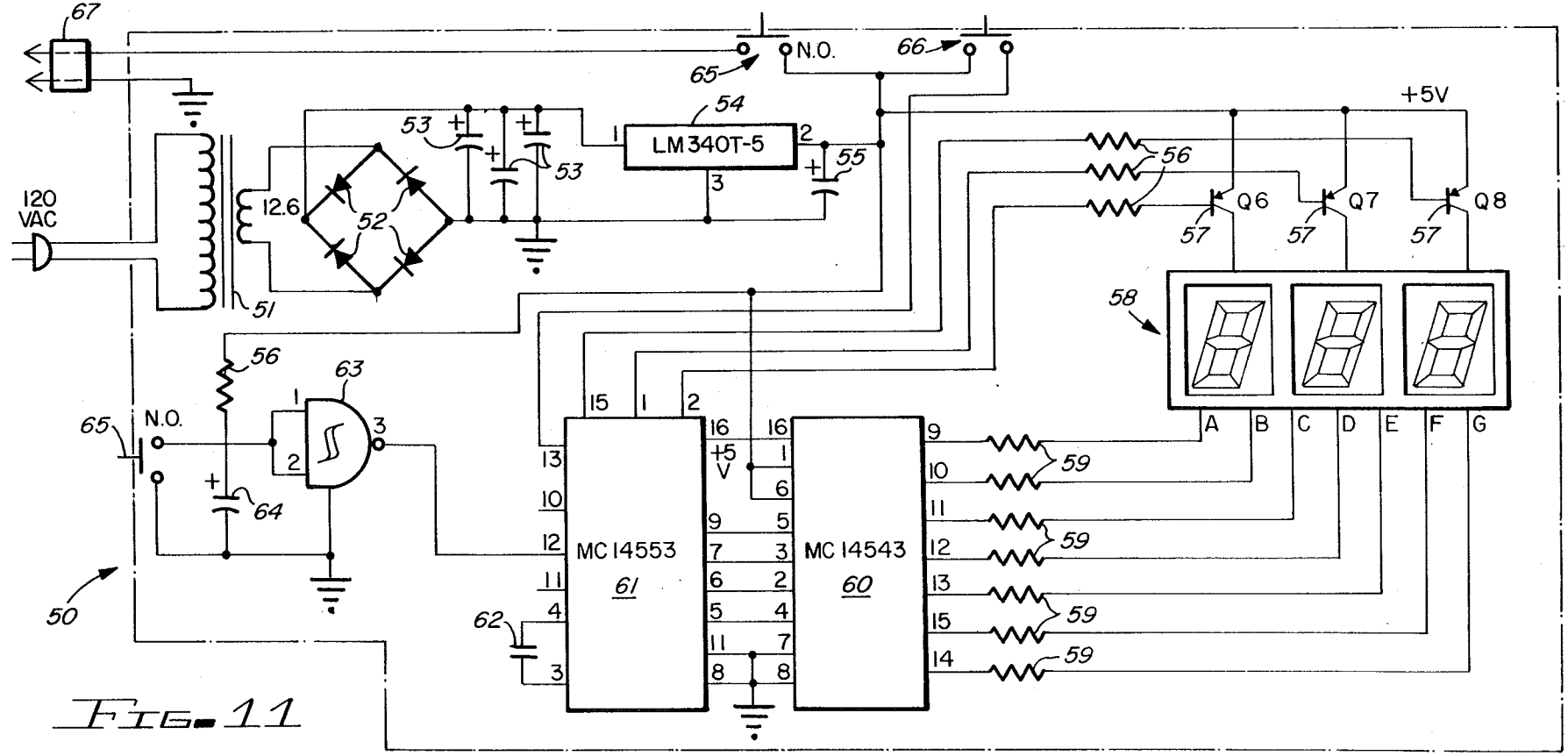
FIG. 11 shows a schematic diagram of the negator.

In FIG. 11 we have shown a schematic diagram of the negator 50 which is powered by 120 volts of electric alternating current provided through an electric cord which is connected, either through a plug or wired directly into an external power source, to the negator 50. The 120 volt alternating current is rectified and regulated to 5 volts through a power transformer 51, 120 volt primary/12.6 volt secondary, IN 4003 diodes 52 converting the current from alternating to direct current, filters 100 UF 35 volt electrolytic capacitors 53 and LM 340T-5 5 volt regulator 54, through filter 0.1 ohm electrolytic capacitor 55, providing power for 74 LS 132 Quad 2 Input Schmitt Trigger 63, which is a contact conditioner to prevent more than a one count advance, MC 14553 3 Digit BCD Counter 61, MC 14543 BCD to 7 segment Latch/Decoder/Driver 60 and 3 Digit Ligit Emiting Diode Display 58. When the key switch 66 is activated, or turned to the on position, and the double pole/single throw momentary on switch 65 is activated, the MC 14543 BCD to 7 Segment Latch-/Decoder/Driver 60 and MC 14553 3 Digit BCD Counter 61 with 0.001 UF capacitor 62 will advance the 3 Digit Light Emiting Diode Display 58 one count when fed through 330 ohm resistor 59 and, coincidently provide 5 volts of direct current to the negator plug 68 through the negator extension cord 67. The key switch 66 is only a reset switch for MC 14543 BCD to 7 Segment Latch/Decoder/Driver 60, MC 14553 3 Digit BDC Counter 61 and 3 Digit Light Emiting Diode Display 58, erasing the number appearing in the 3 Digit Light Emiting Diode Display 58, as shown in FIG. 8, to bring it back to a 000 count. When the negator plug 68, as shown in FIG. 8, is inserted into the negator jack 35, as shown in FIG. 4, of the alarm device 1 and the double pole/single throw momentary on switch 65, as shown in FIG. 8, is activated a voltage of sufficient amplitude will be supplied to to Pin 5, as shown in FIG. 9, of the CD4001 Integrated circuit Quad 2 Input Nor Gate 41, returning same to a quiesent state.

The invention is, of course, not limited to the specific embodiments described and illustrated but may be realized in various modifications, substitutions, adaptions or combinations without departing from the spirit and scope of the appended claims.

We claim:

1. Portable apparatus for releasable attachment to articles subject to surveillance in a surveillance system of type involving radiant energy transmissions into an area of interest, said apparatus comprising:

(a) attachment means for effecting such releasable attachment of said apparatus to an article and including an electrical circuit element having first and second states corresponding respectively to attachment thereof to said article and to release there from such attachment;

(b) alarm means operable for generating an output indicative of an alarm condition;

(c) receiver means for receipt of said radiant energy transmitted messages; and (d) control circuit means connected to both said attachment means and said receiver means means for response to either of said attachment means second state or to said messages received by said receiver means for operating said alarm means to generate said output indicative of an alarm condition.

2. The apparatus claimed in claim 1 further including negator means for connection to said control circuit means for removing said alarm means from such generation of said alarm condition.

3. The apparatus claimed in claim 1 wherein said alarm means is operative to generate a sensible output indicative of such alarm condition.

4. The apparatus claimed in claim 3 wherein said alarm means is operative to generate an audible output indicative of such alarm condition.

5. The apparatus claimed in claim 1 further including a housing for containing said attachment means, said receiver means and said alarm means.

6. The apparatus claimed in claim 5 further including an electrical power supply therefor disposed in said housing.

7. The apparatus claimed in claim 5 wherein said housing includes structure for releasable receipt of said negator means.

8. Portable apparatus for releasable attachment to articles subject to surveillance comprising:

(a) attachment means for effecting such releasable attachment of said apparatus to an article and including an electrical circuit element having first and second states corresponding respectively to attachment thereof to said article and to release thereof from such attachment;

(b) alarm means operable for generating an output indicative of an alarm condition;

(c) control circuit means connected to said alarm means and to said attachment means for response to said attachment means second state for operating said alarm means to generate said output indicative of an alarm condition; and (d) negator means for connection to said control circuit means for removing said alarm means from such generation of said alarm condition.

9. The apparatus claimed in claim 8 wherein said alarm means is operative to generate a sensible output indicative of such alarm condition.

10. The apparatus claimed in claim 9 wherein said alarm means is operative to generate an audible output indicative of such alarm condition.

11. The apparatus claimed in claim 8 further including a housing for containing said attachment means and said alarm means.

12. The apparatus claimed in claim 11 further including an electrical power supply therefor disposed in said housing.

13. The apparatus claimed in claim 11 wherein said housing includes structure for releasable receipt of said negator means.

14. Portable apparatus for releasable attachment to articles subject to surveillance in asurveillance system to type involving radiant energy transmissions into an area of interest, said apparatus comprising:

(a) alarm means operable for generating an output indicatiuve of an alarm condition;

(b) receiver means for receipt of said radiant energy transmitted messages;

(c) control circuit means connected to said alarm means and to said receiver means for response and to said messages received by said receiver means for operating said alarm mean to generate said output indicative of an alarm condition; and (d) negator means for connection to said control circuit means for removing said alarm means from such generation of said alarm condition.

15. The apparatus claimed in claim 14 wherein said alarm means is operative to generate a sensible output indicative of such alarm condition.

16. The apparatus claimed in claim 15 wherein said alarm means is operative to generate an audible output indicative of such alarm condition.

17. The apparatus claimed in claim 14 further including a housing for containing said attachment means, said receiver means and said alarm means.

18. The apparatus claimed in claim 17 further including an electrical power supply therefor disposed in said housing.

19. The apparatus claimed in claim 17 wherein said housing includes structure for releasable receipt of said negator means.

20. An article surveillance system comprising the apparatus claimed in claim 1 and further including transmitter means for effecting such radiant energy transmissions into said area of interest.

21. An article surveillance system comprising the apparatus claimed in claim 2 and further including transmitter means for effecting such radiant energy transmissions into said area of interest.

22. An article surveillance system comprising the apparatus claimed in claim 8 and further including transmitter means for effecting such radiant energy transmissions into said area of interest.

23. An article surveillance system comprising the apparatus claimed in claim 14 and further including transmitter means for effecting such radiant energy transmissions into said area of interest.

* * * * *